US006514393B1

(12) United States Patent
Contolini et al.

(10) Patent No.: US 6,514,393 B1
(45) Date of Patent: Feb. 4, 2003

(54) ADJUSTABLE FLANGE FOR PLATING AND ELECTROPOLISHING THICKNESS PROFILE CONTROL

(75) Inventors: Robert J. Contolini, Lake Oswego, OR (US); Andrew J. McCutcheon, Vancouver, WA (US)

(73) Assignee: Novellus Systems, Inc., San Jose, CA (US)

( * ) Notice: Subject to any disclaimer, the term of this patent is extended or adjusted under 35 U.S.C. 154(b) by 0 days.

(21) Appl. No.: 09/542,890

(22) Filed: Apr. 4, 2000

(51) Int. Cl.[7] ..... C25C 17/04; C25D 17/06
(52) U.S. Cl. ..... 204/297.03; 204/297.01
(58) Field of Search ..... 204/297.03, 297.01

(56) References Cited

U.S. PATENT DOCUMENTS 4,469,566 A 9/1984 Wray
5,804,052 A 9/1998 Schneider
6,136,163 A * 10/2000 Cheung et al. ..... 204/198
6,228,233 B1 * 5/2001 Lakshmikanthan et al. . 204/277
6,254,760 B1 * 7/2001 Shen et al. ..... 204/198
6,258,223 B1 * 7/2001 Cheung et al. ..... 204/242

* cited by examiner

*Primary Examiner*—Nam Nguyen
*Assistant Examiner*—Erica Smith-Hicks
(74) *Attorney, Agent, or Firm*—Patton Boggs LLP

(57) ABSTRACT

An electrochemical reactor is used to electrofill damascene architecture for integrated circuits or for electropolishing magnetic disks. An inflatable bladder is used to screen the applied field during electroplating operations to compensate for potential drop along the radius of a wafer. The bladder establishes an inverse potential drop in the electrolytic fluid to overcome the resistance of a thin film seed layer of copper on the wafer.

7 Claims, 3 Drawing Sheets

ADJUSTABLE FLANGE FOR PLATING AND ELECTROPOLISHING THICKNESS PROFILE CONTROL

BACKGROUND OF THE INVENTION

1. Field of the Invention

The present invention pertains to the field of flanges that are used to hold items in electrochemical reactors for electroplating and electropolishing operations. More specifically, the flange contains an inflatable bladder that can be selectively inflated and deflated to vary the electric field at the wafer during electrolysis for more uniform thickness control with applicability in making thin films for use in integrated circuits, as well as electronic memory storage devices.

2. Statement of the Problem

Integrated circuits are formed on wafers by well known processes and materials. These processes typically include the deposition of thin film layers by sputtering, metal-organic decomposition, chemical vapor deposition, plasma vapor deposition, and other techniques. These layers are processed by a variety of well known etching technologies and subsequent deposition steps to provide a completed integrated circuit.

A crucial component of integrated circuits is the wiring or metalization layer that interconnects the individual circuits. Conventional metal deposition techniques include physical vapor deposition, e.g., sputtering and evaporation, and chemical vapor deposition techniques. Some integrated circuit manufacturers are investigating electrodeposition techniques to deposit primary conductor films on semiconductor substrates.

Wiring layers have traditionally been made of aluminum and a plurality of other metal layers that are compatible with the aluminum. In 1997, IBM introduced technology that facilitated a transition from aluminum to copper wiring layers. This technology has demanded corresponding changes in process architecture towards damascene and dual damascene architecture, as well as new process technologies.

Copper damascene circuits are produced by initially forming trenches and other embedded features in a wafer, as needed for circuit architecture. These trenches and embedded features are formed by conventional photolithographic processes. A barrier layer, e.g., of silicon nitride, is next deposited. An initial seed or strike layer about 125 nm thick is then deposited by a conventional vapor deposition technique, and this seed layer is typically a thin conductive layer of copper or tungsten. The seed layer is used as a base layer to conduct current for electroplating thicker films. The seed layer functions as the cathode of the electroplating cell as it carries electrical current between the edge of the wafer and the center of the wafer including fill of embedded structures, trenches or vias. The final electrodeposited thick film should completely fill the embedded structures, and it should have a uniform thickness across the surface of the wafer.

Generally, in electroplating processes, the thickness profile of the deposited metal is controlled to be as uniform as possible. This uniform profile is advantageous in subsequent etchback or polish removal steps. Prior art electroplating techniques are susceptible to thickness irregularities. Contributing factors to these irregularities are recognized to include the size and shape of the electroplating cell, electrolyte depletion effects, hot edge effects and the terminal effect.

For example, because the seed layer is initially very thin, the seed layer has a significant resistance radially from the edge to the center of the wafer. This resistance causes a corresponding potential drop from the edge where electrical contact is made to the center of the wafer. Thus, the seed layer has a nonuniform initial potential that is more negative at the edge of the wafer. The associated deposition rate tends to be greater at the wafer edge relative to the interior of the wafer. This effect is known as the terminal effect.

One solution to the end effect would be to deposit a thicker seed layer having less potential drop from the center of the wafer to the edge, however, thickness uniformity of the final metal layer is also impaired if the seed layer is too thick. FIG. 1 shows a prior art seed layer 100 made of copperformed atop barrier layer 102 and a dielectric wafer 104. A trench or via 106 has been cut into wafer 104. Seed layer 100 thickens in mouth region 108 with thinning towards bottom region 110. The thickness of seed layer 100 is a limiting factor on the ability of this layer to conduct electricity in the amounts that are required for electroplating operations. Thus, during electrodeposition, the relatively thick area of seed layer 100 at mouth region 108 grows more rapidly than does the relatively thin bottom region 110 with the resultant formation of a void or pocket in the area of bottom region 110 once mouth region 108 is sealed.

FIG. 2 shows an ideal seed layer 200 made of copper formed atop barrier layer 202 and a dielectric wafer 204. A trench or via 206 has been cut into wafer 204. Ideal seed layer 200 has three important properties:

1. Good uniformity in thickness and quality across the entire horizontal surface 208 of wafer 204.;
2. Excellent step coverage exists in via 206 consisting of continuous conformal amounts of metal deposited onto the sidewalls; and
3. In contrast to FIG. 1, there is minimal necking in the mouth region 210.

It is difficult or impossible to obtain these properties in seed layers having a thickness greater than about 120 nm to 130 nm.

The electroplating of a thicker copper layer should begin with a layer that approximates the ideal seed layer 200 shown in FIG. 2. The electroplating process will exacerbate any problems that exist with the initial seed layer due to increased deposition rates in thicker areas that are better able to conduct electricity. The electroplating process must be properly controlled or else thickness of the layer will not be uniform, there will develop poor step coverage, and necking of embedded structures can lead to the formation of gaps of pockets in the embedded structure.

A significant part of the electroplating process is the electrofilling of embedded structures. The ability to electrofill small, high aspect ratio features without voids or seams is a function of many parameters. These parameters include the plating chemistry; the shape of the feature including the width, depth, and pattern density; local seed layer thickness; local seed layer coverage; and local plating current. Due to the requisite thinness of the seed layers, a significant potential difference exists between the center of a wafer and the edges of a wafer. Poor sidewall coverage in embedded structures, such as trench 106 in FIG. 1, develops higher average resistivity for current traveling in a direction that is normal to the trench. Due to these factors in combination, there is a finite range of current densities over which electrofilling can be performed.

Manufacturing demands are trending towards circumstances that operate against the goal of global electrofilling of embedded structures and thickness uniformity. Industry trends are towards thinner seed films, larger diameter wafers, increased pattern densities, and increased aspect ratio of circuit features. The trend towards thinner seed layers is required to compensate for an increased percentage of necking in smaller structures, as compared to larger ones. For example, FIG. 3 shows a comparison between etched versus seeded features for a HCM PVD process. A 45° line is drawn to show no necking, but the data shows necking as the seeded feature width rolls downward in the range from 0.3 $\mu$m to 0.15 $\mu$m.

Regarding the trend towards larger diameter wafers, it is generally understood that the deposition rate, as measured by layer thickness, can be maintained by scaling total current through the electrochemical reactor in proportion to the increased surface area of the larger wafer. Thus, a 300 mm wafer requires 2.25 times more current than does a 200 mm wafer. Electroplating operations are normally performed by using a clamshell wafer holder that contacts the wafer only at its outer radius. Due to this mechanical arrangement, the total resistance from the edge of the wafer to the center of the wafer is proportional to the radius. Nevertheless, with the higher applied current at the edge of the larger wafer, which is required to maintain the same current density for process uniformity, the total potential drop from the edge to the center of the wafer is greater for the larger diameter wafer. This circumstance leads to an increased rate of deposition that increases with radius where deposition is measured by layer thickness. While the problem of increasing deposition rate with radius exists for all wafers, it is exacerbated in the case of larger wafers.

U.S. Pat. No. 4,469,566 to Wray teaches electroplating of a paramagnetic layer with use of dual rotating masks each having aligned aperture slots. Each mask is closely aligned with a corresponding anode or cathode. The alternating field exposure provides a burst and the drive mechanism are incapable of varying the distance between each mask and its corresponding anode or cathode, and they also are incapable of varying the mask surface area of their corresponding anode or cathode.

U.S. Pat. No. 5,804,052 to Schneider teaches the use of rotating roller-shaped bipolar electrodes that roll without short circuit across the surface being treated ion the manner of a wiper.

The foregoing discussion describes electroplating operations and focuses upon the problems that arise from thin film seed layers and the necessity of using increasingly thin seed layers. In electroplating operations, the wafer is connected and used as a cathode or the negative terminal of the electrochemical reactor. Similar problems arise in electropolishing operations where the wafer or another object is connected for use as the anode to remove rough features, e.g., from the surface of a magnetic disk for use in a computer hard drive. Portions of the film are preferentially removed in a radially outboard direction.

None of the aforementioned patents overcome the special problems of electroplating metal films for use in integrated circuits. There exists a need to compensate the potential drop in conductive metal films while electroplating or electropolishing these films to facilitate the production of layers having uniform thicknesses and global electrofilling of embedded features.

Solution

The present invention overcomes the problems that are outlined above by providing a flange or object-holding device having a variable field shaping element, i.e., an inflatable bladder, that is placed in the electrochemical reactor to compensate for the potential drop in the thin conductive film during electroplating or electropolishing operations. The shield compensates for this potential drop by shaping an inverse potential drop in the electrolyte to achieve a uniform current distribution on the surface of the object being plated or polished.

A flange according to the present invention is used to hold objects including semiconducting wafers, magnetic disks and the like in an electrochemical reactor. The flange provides an ability to control field potential at the surface of the object being held for more uniform electrochemical results, such as the thickness of an electroplated metal layer. The flange includes three primary sections, which may be bonded together, bolted, or integrally formed.

An object-retaining segment establishes electrical contact with the margins of a wafer, magnetic disk, or other object. The object-retaining segment holds the object to present a surface of the object for electrochemical reaction. An inflatable elastomeric bladder is disposed around the object-retaining segment in a manner permitting selective inflation and deflation of the bladder. The bladder shields corresponding surface area on an object held in the object-retaining segment from electric field potential. An intermediate segment separates the object-retaining segment from the inflatable bladder to prevent the inflatable bladder from damaging objects held in the object-retaining segment.

In preferred embodiments, the intermediate section has at least one hole permitting gas to escape from between the object-retaining segment and the inflatable bladder. The flange is preferably formed of two bivalve halves each formed in a semicircle or in 180° arc. The halves slide together to form a circle.

In operation, the flange is placed in an electrochemical reactor between a cathode and an anode. Current flows through an electrolytic fluid in the reactor for electropolishing or electroplating operations. A computer uses a pressurized gas source and controls electrically actuated vales to continuously adjust the position of the inflatable bladder for the purpose of maintaining a constant current density across the surface of the wafer, magnetic disk, or other object held in the object retaining segment.

DETAILED DESCRIPTION OF THE PREFERRED EMBODIMENTS

Figure 1:
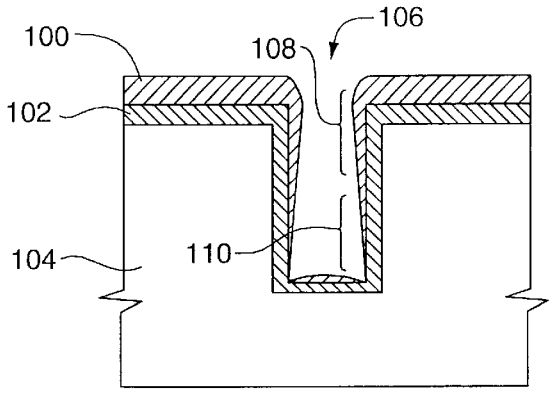
FIG. 1 PRIOR ART
FIG. 1 depicts a prior art seed layer deposited on a wafer to form an undesirable necked feature at the mouth of a trench.
Figure 2:
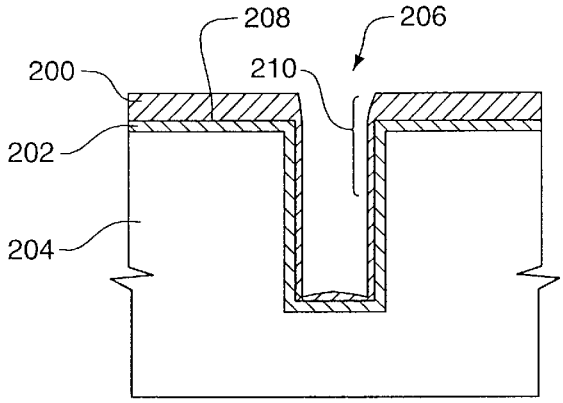
FIG. 2 PRIOR ART
FIG. 2 depicts an ideal seed layer that is deposited to provide uniform coverage across a trench feature, as well as on the surface of the wafer.
Figure 3:
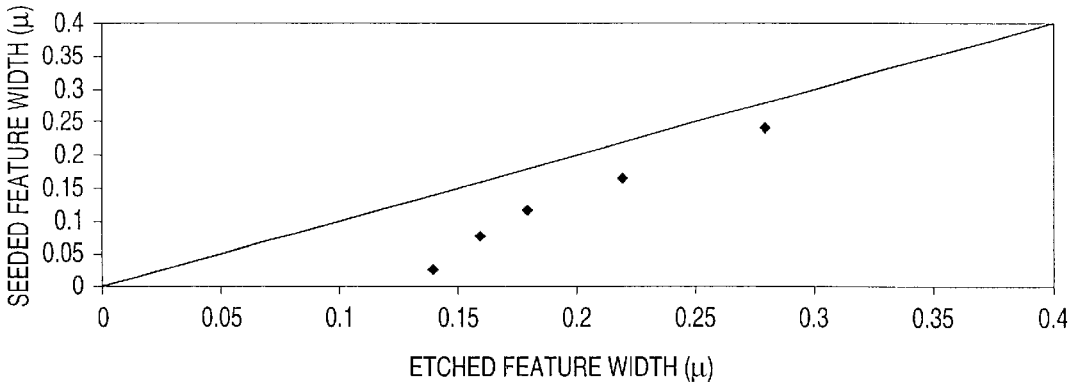
FIG. 3 PRIOR ART
FIG. 3 shows data from a HCM PVD process demonstrating rolloff in a comparison between etched feature width and seeded feature width that indicates necking as a percentage of feature width increases as the etched feature width decreases.
Figure 4:
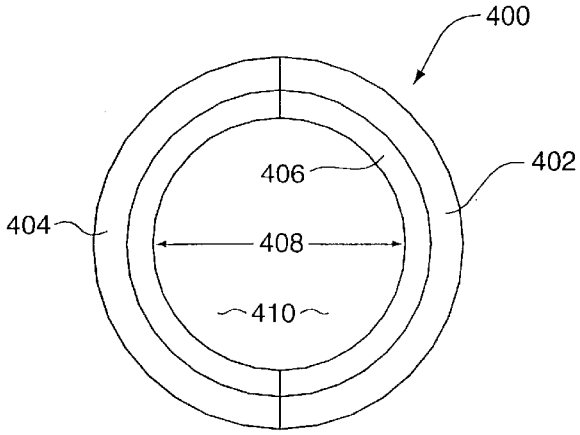
FIG. 4 depicts a first embodiment of a flange having an inflatable bladder having two bivalve halves according to a preferred embodiment of the present invention.
Figure 5:
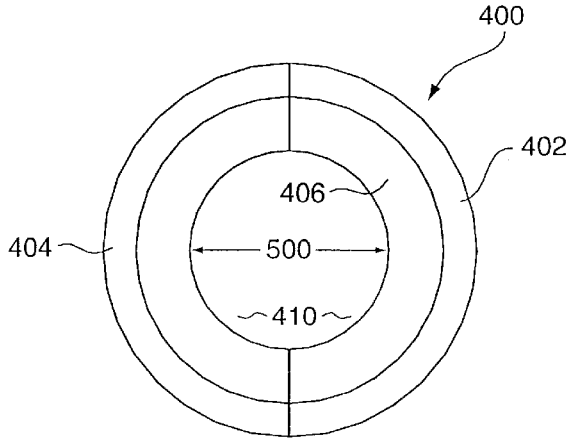
FIG. 5 depicts the flange of FIG. 4 with the bladder inflated to a second position.

FIG. 4 depicts a bottom view of a wafer-holding device 400 according to the present invention. Wafer-holding device 400 is made of two bivalve halves 402 and 404 with one half being a mirror image of the other. Each half has an inflatable bladder e.g., as half 402 has bladder 406. Bladder 406 is deflated to a relaxed position corresponding to diameter 408 superimposed over an overlying wafer 410 that is retained in halves 402 and 404. FIG. 5 depicts wafer-holding device 400 with the bladder 406 inflated to occupy a decreased diameter 500 that covers or shields increasingly more of the overlying wafer 500.

Figure 6:
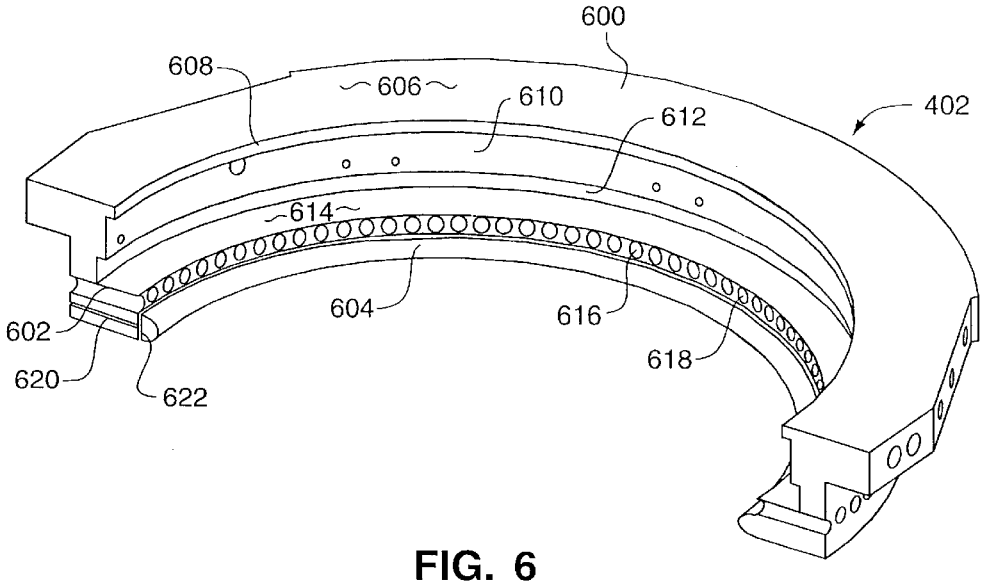
FIG. 6 depicts a half of the flange shown in FIGS. 4 and 5.

FIG. 6 depicts bivalve half 402 in additional detail. The main components of half 402 are three integrally formed sections including a wafer-holding section 600, an intermediate section 602 and an inflatable bladder 604. The wafer-holding section 600 includes a top surface 606 leading to a radially inboard lip 608, which falls to a vertical section 610 of increased radial diameter. The projection of lip 608 in this manner permits mechanical binding of section 600 with corresponding structure for mounting half 402 in an electrochemical reactor in the intended environment of use. A radial channel 612 has an increased radius with respect to vertical section 610 and can be used to retain a wafer against intermediate section 602 for electroplating operations or a magnetic disk for electropolishing operations. Intermediate section 602 includes a wall 614 of decreased radius with respect to channel 612 and vertical section 610. A plurality of holes, e.g., holes 616 and 618, extend through wall 614 to permit the escape of trapped gas that could, otherwise, interfere with electrochemical reaction at the surface of a wafer to be held in half 402. Gas transit pathways for inflation and deflation of bladder 604, e.g., bladder purge path 620, are formed into wall 614 for the ingress and egress of gas. The lower perimeter of wall 614 contains a recess corresponding to the outer diameter of bladder 604 for the retention of bladder 604 therein.

Figure 7:
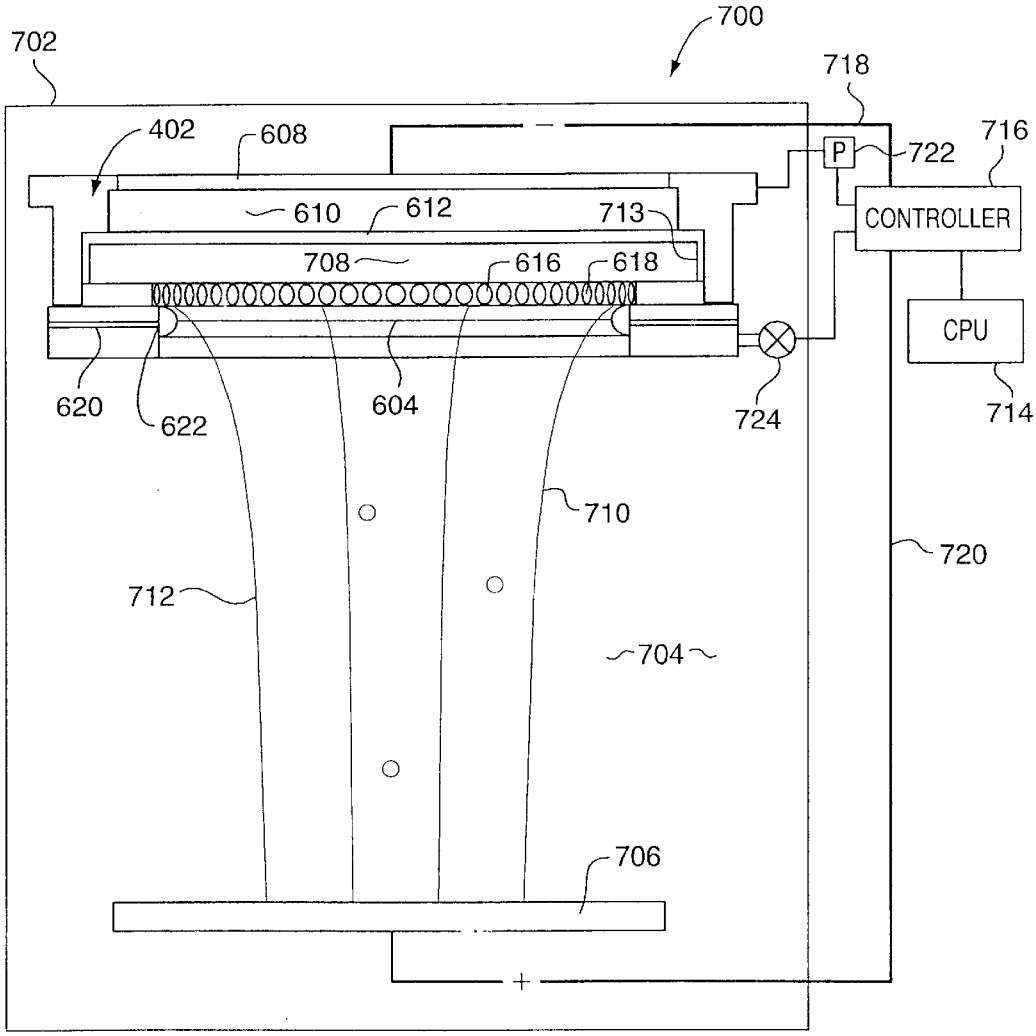
FIG. 7 depicts an electrochemical reactor with the flange shown in FIGS. 4 and 5 installed therein.

FIG. 7 depicts an electrochemical reactor 700 with the wafer-holding device 400 represented by bivalve half 402. The electrochemical reactor 700 includes a reservoir 700 that contains an electrolytic fluid 702 for use in performing electroplating reactions. This electrolytic fluid 702 can, for example, include a copper carboxylate or copper alkoxide in combination with cupric ammonium salts to enhance electrical conductivity. An anode 706 is typically made of the metal being plated. Bivalve half 402 contacts the wafer 708 to serve as a wafer-holder to place wafer 708 in position for use as a cathode in electrochemical reactor 700. A plurality of field lines, e.g., such as the field represented by lines 710 and 712 extend from the anode 706 to the bivalve half 402. The polarity of electrochemical reactor 700 may be reversed for electropolishing operations, namely, to place a negative charge on anode 706 to convert anode 706 to the cathode with a corresponding positive charge on bivalve half 402 making bivalve half 402 the anode.

The field lines 710 and 712 show the mechanism that bladder 604 uses to compensate for the radial drop in potential across the surface of wafer 708. Field lines 710 and 712 curve towards outer radius 713 of wafer 708 to provide an inverse potential drop in electrolytic fluid 704, which compensates for the potential drop by the diameter of bladder 604. Thus, the current is concentrated at the center of the wafer, which is in vertical alignment with bladder 604.

The potential drop along the surface of wafer 708 changes with time as the copper plating on wafer 708 increases in thickness. The increased thickness reduces the total potential drop in the copper. There is a corresponding need to inflate or deflate bladder 604 in a continuous manner to offset the variable potential drop along the surface of wafer 708. This movement is accomplished by a central processor 714 and a controller 716. Central processor 714 monitors the current and voltage on lines 718 and 720 using signals provided by controller 716. Central processor interprets these signals and causes a corresponding reduction or increase in the diameter of bladder 604 by injecting gas from pressurized source 722 to increase the diameter or opening electronically actuated valve 724 to reduce the diameter of bladder 604. Processor 714 is programmed to interpret these signals by the use of a neutral network or an adaptive filter using a set of measurements overtime corresponding to actual thickness measurements over the surface of the wafer 708. Alternatively a set of synthetic data may be created from mathematical modeling for this purpose using conventional equations to model the projection of a field through an electrolyte, or the mathematical model itself may be solved to adjust the diameter of bladder 604.

Those skilled in the art will understand that the preferred embodiments described above may be subjected to apparent modifications without departing from the true scope and spirit of the invention. The inventors, accordingly, hereby state their intention to rely upon the Doctrine of Equivalents, in order to protect their full rights in the invention.

We claim:

1. A flange for use in holding objects including semiconducting wafers and magnetic disks in an electrochemical reactor with ability to control field potential at the surface of the object being held for more uniform electrochemical results, comprising:

an object-retaining segment providing means for establishing electrical contact with the margins of an object held in said object-retaining segment while presenting a surface of said object for electrochemical reaction;

an inflatable bladder disposed around said object-retaining segment in a manner permitting selective inflation and deflation of said bladder to shield a corresponding portion of surface area of the said object from electric field potential when said object is held in said object-retaining segment for presenting said surface for electrochemical reaction; and an intermediate segment separating said object-retaining segment from said inflatable bladder to prevent said inflatable balder from damaging objects held in said object-retaining segment when objects are held in said object-retaining segment.

2. The flange as set forth in claim 1 wherein said intermediate section has at least one hole permitting gas to escape from between said object-retaining section and said inflatable bladder.

3. The flange as set forth in claim 1 wherein said object-retaining section defines a first arcuate aperture.

4. The flange as set forth in claim 3 wherein said inflatable bladder defines a second arcuate aperture.

5. The flange as set forth in claim 4 wherein said first arcuate aperture is in coaxial alignment with said second arcuate aperture.

6. The flange as set forth in claim 1 wherein said object-retaining section includes a channel providing said means for establishing electrical contact.

7. The flange as set forth in claim 1 wherein said flange is constructed of two bivalve halves.

* * * * *